US008077048B2

(12) United States Patent
Almiman

(10) Patent No.: US 8,077,048 B2
(45) Date of Patent: Dec. 13, 2011

(54) SMOKE MONITOR

(75) Inventor: Fozeyah Saleh Almiman, Riyadh (SA)

(73) Assignee: King Saud University, Riyadh (SA)

( * ) Notice: Subject to any disclaimer, the term of this patent is extended or adjusted under 35 U.S.C. 154(b) by 561 days.

(21) Appl. No.: 12/245,640

(22) Filed: Oct. 3, 2008

(65) Prior Publication Data

US 2009/0109042 A1 Apr. 30, 2009

(51) Int. Cl.
*G08B 17/10* (2006.01)

(52) U.S. Cl. ..... 340/628

(58) Field of Classification Search ..... 340/628, 340/577, 629, 630, 691.6; 600/529, 532
See application file for complete search history.

(56) References Cited

U.S. PATENT DOCUMENTS 4,881,554 A * 11/1989 Obasogie ..... 131/270
6,447,731 B1 * 9/2002 Sun et al. ..... 422/121
7,052,468 B2 * 5/2006 Melker et al. ..... 600/532
2006/0200322 A1 * 9/2006 Blondal et al. ..... 702/177
2008/0087289 A1 * 4/2008 Tanner ..... 131/328

* cited by examiner

*Primary Examiner* — Phung Nguyen
(74) *Attorney, Agent, or Firm* — Hart IP Law and Strategies LLC

(57) ABSTRACT

Systems and methods for a smoke monitor are described. In one aspect, a smoke monitor includes a detector to sense when a user lights a smoking device such as a cigarette, pipe, etc. In one implementation, for example, such detection is made by detecting the audible sound of a lighter, via a smoke detector, and/or so on. In one implementation, the smoke monitor includes a counter that counts the number of smoking devices lit by a user, for example, over a predetermined amount of time. Exceeding a threshold number of smoking devices (e.g., lighting one or more smoking devices) over that period of time may cause the smoke monitor to implement one or more configurable events such as audio alarms, vibrations, etc. In one implementation, and responsive to the smoke monitor detecting smoke, a particle generator coupled to the smoke monitor generates particles to freshen surrounding air.

19 Claims, 2 Drawing Sheets

SMOKE MONITOR

This non-provisional patent application claims priority to Saudi Arabian Patent Application Serial Nos. 7280538 and 7280539, filed Oct. 3, 2007, the contents of which are herein incorporated by reference in their entirety.

BACKGROUND

A tobacco smoker may desire to quit smoking, for example, due to the adverse health consequences of smoking to the smoker. Moreover, smoking tobacco releases harmful particles into the air surrounding the smoker. This second-hand smoke may negatively affect health of those in proximity to the smoker. Smoking tobacco is an addictive habit and generally is not easily given up by a smoker.

SUMMARY

Systems and methods for a smoke monitor are described. In one aspect, a smoke monitor includes a detector to sense when a user lights a smoking device such as a cigarette, pipe, etc. In one implementation, for example, such detection is made by detecting the audible sound of a lighter, via a smoke detector, and/or so on. In one implementation, the smoke monitor includes a counter that counts the number of smoking devices lit by a user, for example, over a predetermined amount of time. Exceeding a threshold number of smoking devices (e.g., lighting one or more smoking devices) over that period of time may cause the smoke monitor to implement one or more configurable events such as audio alarms, vibrations, etc. In one implementation, and responsive to the smoke monitor detecting smoke, a particle generator coupled to the smoke monitor generates particles to freshen surrounding air.

This Summary is provided to introduce a selection of concepts in a simplified form that are further described below in the detailed description. This Summary is not intended to identify key features or essential features of the claimed subject matter, nor is it intended to be used as an aid in determining the scope of the claimed subject matter.

DETAILED DESCRIPTION

Overview

In one aspect, a smoke monitor is provided to remind a user that he/she is smoking. This may provide incentive for the user to change his/her habits and reduce the user's dependence on smoking. In one implementation, the apparatus also releases negative ions or ozone responsive to detecting smoke to reduce the quantity of harmful particles in the air in proximity to the smoker. This latter aspect generally improves air quality in the vicinity of the smoker. In one implementation, the smoke monitor may be combined with wearable devices, such as wrist watches, bracelets, necklaces, and/or so on. In other implementations, wearable devices for a smoke monitor may be attached to clothing, such as pants, shirts, hats, belts, or other articles of clothing. In one implementation, the apparatus may detect and monitor the number of smoking devices used by a smoker or smoking incidents over a predetermined time period. Such a count can be manually implemented (e.g., via a user button press) or automatically implemented (e.g., by detecting smoke device lighting events). The smoking devices may be cigarettes, cigars, pipes, etc.

An Exemplary System for a Smoke Monitor

Figure 1:
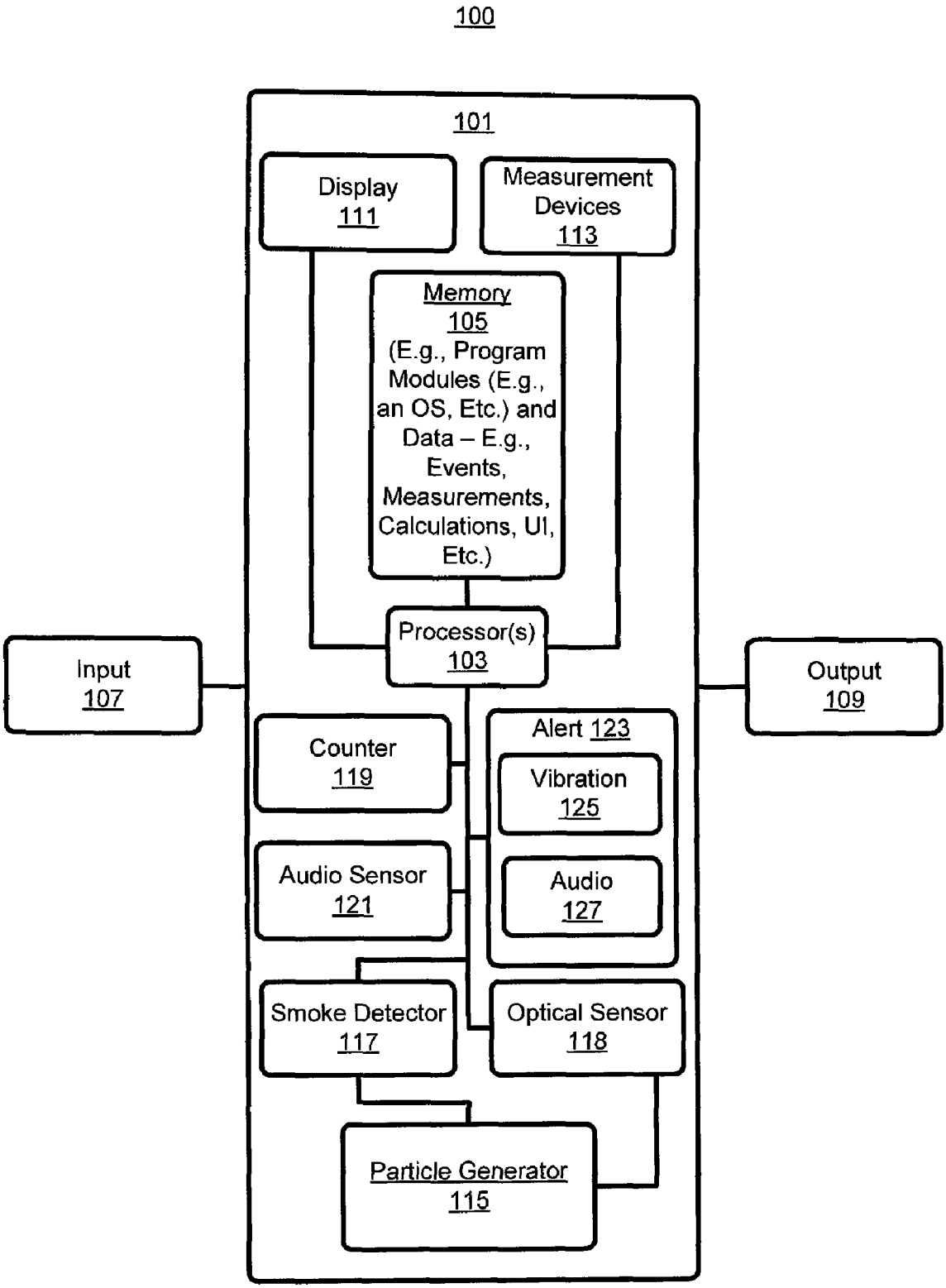
FIG. 1 shows an exemplary system for a smoke monitor, according to one embodiment.

FIG. 1 shows an exemplary system 100 for a smoke monitor according to one embodiment. System 100 includes smoke monitor 101. In this implementation, for example, the smoke monitor 101 includes a processor 103 coupled to a system memory 105. The system memory comprises computer-program instructions (shown as "program modules") executable by the processor 103 to receive and process inputs 107 and generate outputs 109. Inputs 107 may include, for example: smoke from a smoking device, photon information from a light source (e.g., a lighter or match), signals indicating such sensed phenomena (e.g., smoke, a light flash, etc.), audio data (e.g., sound of a lighter or match strike, etc.), one or more of signals from an on/off switch, a keypad, a keyboard, dials, buttons, a Universal Serial Bus (USB), a wireless interface, an infrared interface, and/or so on. In one implementation, at least a subset of the inputs 107 represent, for example, data downloaded from an external computing device. Outputs 109 include, for example, calculated and/or measured data, audio, physical outputs (e.g., vibrations, etc.), information for presentation to a user, etc. Outputs 109 may be directed to any of a number of different arbitrary targets, such as a USB, a wireless interface, an infrared interface, and/or so on. In one implementation, at least a subset of the outputs is used to transfer information from the smoke monitor 101 to an external computing device (e.g., a personal computer, a printer, a mobile device, etc.).

In this implementation, for example, smoke monitor 101 is operatively coupled to one or more displays 111 (e.g., a Liquid Crystal Display (LCD), a Light Emitting Diode (LED), etc.). In one implementation, smoke monitor 101 provides a user interface (UI) such as a button or other user selectable interface (e.g., displayed graphical elements) to allow the user to selectively obtain various information via the one or more displays 111, audio, etc. For example, smoke monitor 101 utilizes the one or more displays 111 to present a user with monitored, sensed, calculated, and/or measured information, e.g., an indication of the number of smoking devices lit by the user, an amount of time between lighting of respective ones of the smoking devices, etc. In one implementation, smoke monitor 101 includes measurement devices 113, for example, a time piece, a calendar, a thermometer, a pulse reader, a blood pressure monitor, and/or other measurement devices. In this scenario, the one or more displays 111 may also display other information/indicators such as time, date, temperature, heart rate, current blood pressure and/or other data.

In one implementation, the smoke monitor 101 includes particle generator 115, such as a negative ion generator and/or an ozone generator. The particle generator 115 may generate negative ions or ozone while the particle generator 115 is active. In one implementation, for example, particle generator 115 is activated by detecting smoke emitted from a smoking device. The smoke may be detected by a smoke detector 117 operatively coupled to smoking monitor 101. In one implementation, smoke detector 117 is calibrated to detect a quantity of smoke typically released by the smoking device. Smoke detector 117 may be calibrated depending on the anticipated location where the user will wear or carry the smoke monitor 101. For example, the calibration may be different if the apparatus 101 is worn on the wrist as a bracelet as compared to on the neck as a necklace. The smoke detector 117, after detecting the presence of the smoke, may send a signal to the processor 103. Responsive to receipt of the signal, processor 103 may then automatically activate the particle generator 115, generate an alarm (e.g., vibration, audio signal, etc). In another implementation, a user manually activates and/or deactivates particle generator 115.

In one implementation, particle generator 115 is mobile in that it is small and light enough to be worn by a user of the smoke monitor.

In one implementation, smoke monitor 101 maintains one or more counters 119 indicating a number of smoking devices (cigarettes, cigars, etc.) used by a user over a configurable period of time. This provides a running tally of smoking devices used by the user, etc. In one implementation, the tally can be reset by the user. The counter 119 may be incremented responsive to detecting a sound/noise produced by a lighter being used by the user to light the smoking device. The noise of the lighter being used may be detected by an audio sensor 121 in the smoke monitor 101. The audio sensor 121 may recognize the characteristic noise of a lighter. A signal from the audio sensor 121 may then be sent to the one or more processors 103 and then to the counter 119. In another embodiment, the audio sensor 121 may send a signal directly to the counter 119. As an alternative method of determining the number of smoking devices used by a user, if a smoke detector 117 is used, such as described above, a signal may be sent from the smoke detector 117 to the one or more processors 103 and then to the counter 119. In another embodiment, the smoke detector 117 may send a signal directly to the counter 119. Upon receipt of the signal, the counter 119 may increase the tally of smoking devices after each new detection of smoke by the smoke detector 117. The counter 119 may send a signal to the one or more processors 103 for processing. The one or more processors 103 may then store the count information in the one or more memories 113.

In one implementation, a user enters into the smoke monitor (e.g., via the UI and/or a button) a target number/limit of smoking devices to be consumed by the user over a predetermined amount of time. For example, a user may set a limit of six (6) or some other arbitrary number of cigarettes (or smoking device lighting events) in a 24-hour period. If the user does not exceed this limit, no action related to smoking may be taken by the device 101, except for processing the count of the number of smoking devices used by the user. If the user exceeds the target in the predetermined period, however, the smoke monitor 101 may respond by activating one or more sets of alerts 123, the particular alerts being selectable by the user or a default set of alerts. In one implementation, the one or more alerts are active only while the user is smoking. Alerts 123 may include a vibration system 125 to vibrate the smoke monitor 101. In one implementation, the vibration system 125 cannot be turned off by the user and may remain on for the entire time a user is smoking (e.g., until smoke is no longer detected, possibly delimiting the end of a particular smoking event for a particular smoking device) or for a set duration.

In one implementation, and if an audio sensor 121 is used to detect a smoking device ignition event, vibration system 125 is activated responsive to detecting a noise attributed/mapped to a lighter or match. In this scenario, the vibrations may remain active for a set configurable duration. If a smoke detector 117 is used, such as described above, the vibration system 125 may be initiated upon the first detection of smoke and may remain active until smoke is no longer detected. The one or more alerts 123 may also include an audio alert 127. The audio alert 127 may be a loud and/or annoying noise. The audio alert 127 may be generated by a speaker or other similar device. In one implementation, the audio alert 127 cannot be turned off by the user and remains on for a configurable or other set duration. If an audio sensor 121 is used, such as described above, the audio alert 127 may be activated upon detection of noise from a lighter and may remain active for a set duration. If a smoke detector 117 is used, such as described above, the audio alert 127 may be initiated upon the first detection of smoke and may remain active until smoke is no longer detected. Such alerts and responses are configurable in one or more of type, duration, and intensity, to meet the particular needs of the user.

Figure 2:
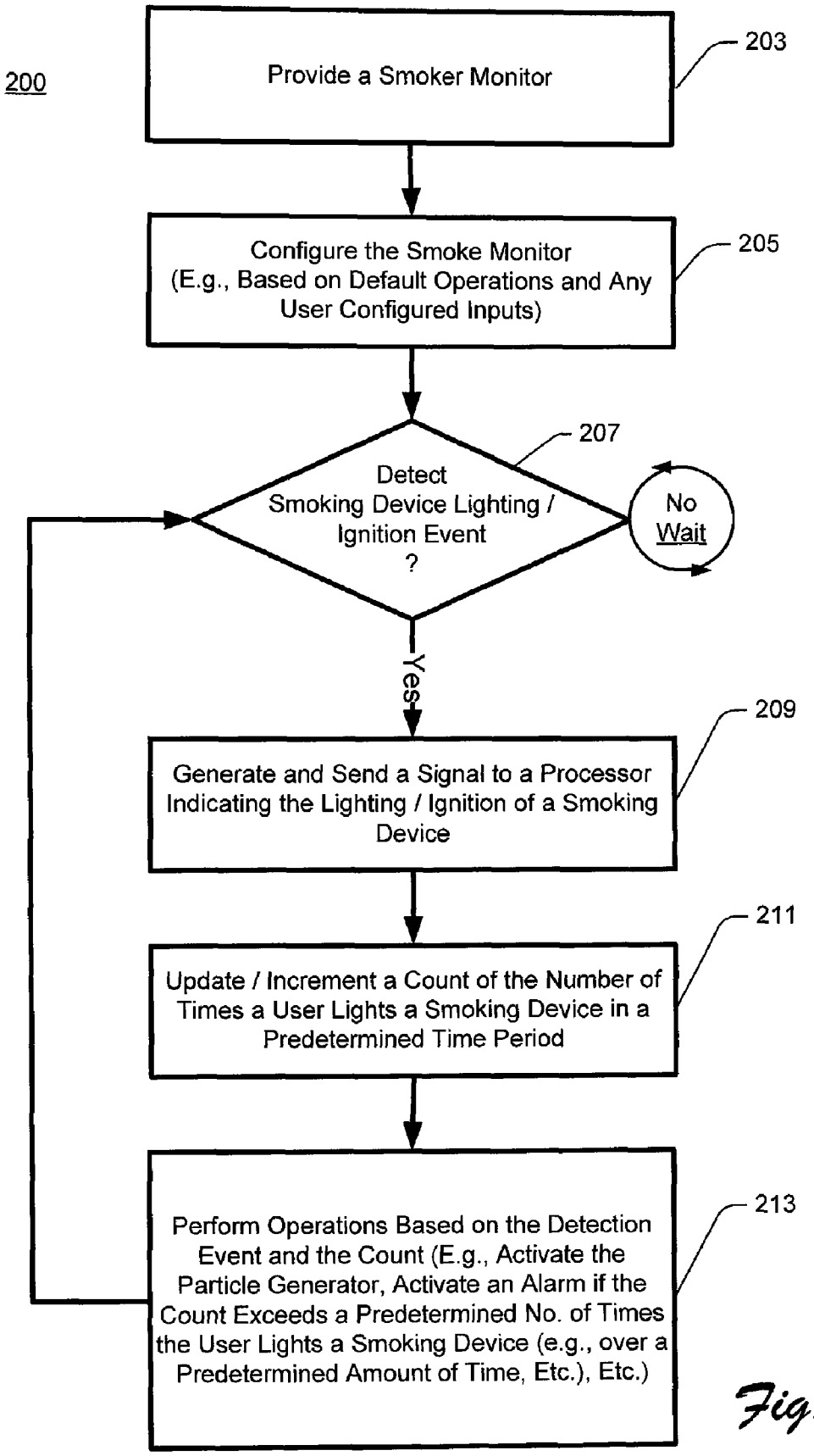
FIG. 2 shows an exemplary method for a smoke monitor, according to one embodiment.

FIG. 2 shows an exemplary procedure 200 for a smoke monitor according to one embodiment. At block 203, procedure 200 provides a smoke monitor (e.g., smoke monitor 101 of FIG. 1). In one implementation, the smoke monitor 101 includes a smoke detector 117, a particle generator 115, an audio sensor 121, an optical sensor 118, and an alert system 123. At block 205, the procedure configures the smoke monitor 101 for operation. In one implementation, such operations are automatically based on hardwired default values implemented by an operating system ("OS," shown as a respective portion of program modules in memory 105 of FIG. 1). For example, the monitor is automatically configured to generate negative ions or ozone responsive to a first detection of a lit smoking device. In another example, the smoke monitor 101 is configured to generate an alarm after detection of the user lighting a second smoking device (e.g., in a predetermined amount of time, etc.), and/or so on. These default operations are exemplary, and many other arbitrary default configurations can be considered based on the desired smoke monitor operation. Operations of block 205 also configure the smoke monitor 101 based on user configured preferences (e.g., no alarm/alert generated until after user has lit three smoking devices, etc.).

Operations of block 207 determine if a smoking device lighting or ignition event has been detected. In one implementation, inputs/events received from a smoke detector, a sound detector, and/or an optical sensor are used to detect whether a user of the smoke monitor 101 has lit a smoking device. If such event has not been detected, the operations of procedure 200 wait to detect such an event. Otherwise, operations continue at block 209, where one or more of the detectors 117 (FIG. 1), 118, and 121 sends one or more signals/events to processor 103 indicating that a smoking device ignition event has been detected. In one implementation, for example, such a signal may be generated by the smoke detector indicating the lighting of a smoking device 205. Responsive to receiving the signal, the processor may activate particle generator 115.

At block 211, and responsive to receiving the event, the processor 103 updates a count 119 of the number of smoking devices lit by the user (e.g., over a predetermined time period). At block 213, the processor 103 performs other operations based on the detection event and any other combination of criteria (e.g., the number of smoking devices lit, etc.) such as one or more of activating a particle generator 115, activating an alert 123, etc., for predetermined duration, intensity, etc. Operations of procedure 200 continue at block 207, as described above. For example, an alert system 123 may be activated if the count exceeds a predetermined number of times the user lights a smoking device in the predetermined time period 217. In one implementation, a user of the smoke monitor 101 may reset the device to zero out the counter 119, user preferences, and/or so on, by pushing a button on the device, removing power from the device, etc.

CONCLUSION

Although the above sections describe systems and methods for a smoke monitor in language specific to structural features and/or methodological operations or actions, the implementations defined in the appended claims are not necessarily limited to the specific features or actions described. Rather, the specific features and operations for the smoke monitor are disclosed as exemplary forms of implementing the claimed subject matter.

The invention claimed is:

1. A smoke monitor comprising:

a processor;

a memory coupled to the processor, the memory comprising computer program instructions executable by the processor, and the computer-program instructions, when executed by the processor, implementing instructions comprising:

receiving a signal indicating that smoke has been detected from a smoking device, the signal being generated by an audio sensor responsive to sensing a sound associated with lighting of the smoking device;

responsive to receiving the signal:

evaluating a set of predefined criteria associated with smoking to determine if any actions are to be implemented; and if operations for the evaluating indicate that one or more actions is/are to be implemented, generating at least one alert mapped to an action of the one or more actions to notify a user that at least one of the predefined criteria has been met.

2. The smoke monitor of claim 1 wherein the signal is generated by a smoke detector operatively coupled to the processor.

3. The smoke monitor of claim 1 wherein the particles are negative ions.

4. The smoke monitor of claim 1 wherein the particles are ozone.

5. The smoke monitor of claim 1 wherein the at least one alert is a set of vibrations emitted by a vibration system coupled to the processor.

6. The smoke monitor of claim 1 wherein the at least one alert is an audio alert emitted by an audio system coupled to the processor.

7. The smoke monitor of claim 1 wherein at least a subset of the predefined set of criteria are user configurable.

8. The smoke monitor of claim 1 wherein the predefined set of criteria comprise one or more of a number of times that the user lights respective smoking devices, and an amount of time that has elapsed between successive lightings by the user of respective smoking devices.

9. The smoke monitor of claim 1, further comprising:

a display operatively coupled to the processor, responsive to at least a subset of the predefined set of criteria, displaying information comprising a count of a number of times the user has fit a smoking device, a count of a number of times the user has fit a smoking device in a predetermined time period, current blood pressure of the user, a range of blood pressure of the user over an elapsed period of time, pulse of the user, a range of pulse of the user over an elapsed period of time; and wherein the elapsed period of time is configurable to a user preference or a default period of time.

10. The smoke monitor of claim 1, further comprising one or more measurement devices, the measurement devices comprising one or more of a blood pressure monitor and a pulse meter.

11. A smoke monitor comprising:

means for detecting smoke from a smoking device and producing a corresponding signal;

means for processing the corresponding signal;

means for generating one or more types of particles in response to the corresponding signal;

audio sensor means for detecting a lighting of the smoking device and producing a lighting signal;

means for processing the lighting signal;

means for storing the lighting signal;

means for counting the number of stored lighting signals in a predetermined time period; and means for alerting a user if the number of stored lighting signals in the predetermined time period exceeds a predetermined target number of lighting signals for the predetermined time period.

12. The smoke monitor of claim 11 wherein the means for alerting provides a vibration.

13. The smoke monitor of claim 11 wherein the means for alerting provides an audio alert.

14. The smoke monitor of claim 11 further comprising means for monitoring one or more of a blood pressure and pulse.

15. A method for a smoke monitor, the method comprising:

receiving a signal indicating that smoke has been detected from a smoking device;

responsive to receiving the signal, the signal being generated by an audio sensor responsive to sensing a sound associated with lighting of the smoking device:

evaluating a set of predefined criteria associated with smoking to determine if one or more additional actions are to be implemented; and if operations for the evaluating indicate that an action of the one or more additional actions is to be implemented, generating at least one alert mapped to the action to notify a user that at least one of the predefined criteria has been met.

16. The method of claim 15 wherein the signal is generated by a smoke detector operatively coupled to the processor.

17. The method of claim 15 wherein the particles are one or more of negative ions and ozone.

18. The method of claim 15 wherein the at least one alert is one or more of a set of vibrations emitted by a vibration system, or an audio alert.

19. The method of claim 15 further comprising responsive to receiving the signal, monitoring one or more of a blood pressure and pulse.

* * * * *